United States Patent [19]

Seelenbinder et al.

[11] 4,377,331

[45] Mar. 22, 1983

[54] ATTACHMENT FOR ELIMINATING AMMONIA FUMES FROM DIAZO COPIERS

[75] Inventors: Terry G. Seelenbinder, Elk Grove Village; Richard W. Jackson, Barrington; Thomas D. Kajohn, Jr., Buffalo Grove, all of Ill.

[73] Assignee: AM International, Inc., Chicago, Ill.

[21] Appl. No.: 278,109

[22] Filed: Jun. 29, 1981

[51] Int. Cl.[3] ..... G03D 7/00

[52] U.S. Cl. ..... 354/300; 34/140; 55/70; 55/387; 422/168

[58] Field of Search ..... 354/300; 55/70, 387; 355/27, 100; 422/168; 34/140

[56] References Cited

U.S. PATENT DOCUMENTS

| | | | |
|---|---|---|---|
| 3,679,369 | 7/1972 | Hashimoto et al. | 354/300 |
| 4,059,409 | 11/1977 | Barto et al. | 354/300 |
| 4,162,289 | 7/1979 | Gomez et al. | 55/387 |
| 4,167,319 | 9/1979 | Feitzinger et al. | 354/300 |
| 4,241,989 | 12/1980 | Jackson et al. | 354/299 |
| 4,286,859 | 9/1981 | Kurek | 354/300 |

*Primary Examiner*—L. T. Hix
*Assistant Examiner*—Alan Mathews

[57] ABSTRACT

A copying machine such as a diazotype copier which uses developing reagents which produce fumes is provided with an economical attachment for scavenging any fugitive gas traces and passing them through a treatment cartridge. A manifold mounted in the machine housing has an insert strip with air access openings which can be sized to suit the requirements of a particular copying machine. An air conduit hose has a snap connection with the manifold and with one end of a blower housing the other end of which is attachable to and readily detachable from a unitary disposable supply package which is floor supported and supports the blower housing. The supply package includes a supply of gas generating development material in one portion, and in the other, a gas treatment cartridge of inexpensive disposable character which is so constructed as to pass incoming air down through a central tube and then upwardly through a tube-surrounding space containing gas treatment material and then into the surrounding atmosphere.

7 Claims, 7 Drawing Figures

ATTACHMENT FOR ELIMINATING AMMONIA FUMES FROM DIAZO COPIERS

BACKGROUND OF THE INVENTION

The present invention relates to a diazotype copying apparatus of the kind which employs a fume-producing chemical developing agent, e.g. ammonia, and particularly to a mechanism for dealing with the problem of fumes produced by equipment of this sort.

The gathering of fume contaminated air from such development equipment and passing it through a treatment chamber which contains material with absorbent and/or reagent properties for preventing most of the fumes from passing into the ambient atmosphere is a well known procedure as shown in U.S. Pat. Nos. 3,679,369, 4,059,409 and 4,167,319.

Presently used equipment performs this function successfully, but is characterized by the requirement of a rather complex and expensive adjunct to the copying machine for the sole purpose of rendering the fumes innocuous. Moreover the detection of the appropriate time to change the active ingredients in the treatment chamber offers a problem, and, as presently constructed the job of recharging the treatment chamber with fresh material is one which is either rather awkward and unpleasant for the operator to perform or at best requires the replacement of a filter cartridge of expensive construction.

SUMMARY OF THE INVENTION

According to the present invention the equipment for gathering and treating the fumes is constructed to operate with a treatment efficiency which is the full equivalent of that enjoyed with prior devices, but is so constructed as to be both very simple and to have the nature of an attachment capable of being readily mounted upon previously built copying machines not heretofore equipped with treatment apparatus. The device of the present invention comprises a wand wich is positioned and fastened within the copier housing at a location where the fume release is most likely to occur. The wand is preferably provided with graduated inlet openings so sized as to withdraw air flow of roughly similar values across the full width of the machine. At one end the wand is connected with a conduit which leads to an air moving or blower assembly an outlet of which plugs into a floor-supported disposable package.

The disposable package is made up of two portions, the first being a cardboard cartridge which has a central tube leading the air flow from the top to the bottom of the canister and a redirecting construction which turns the air flow path upward and through a treatment chamber surrounding the central tube and containing absorbents and/or reagents for the fugitive gas traces.

In the same unitary disposable package is a plastic container holding a liquid, e.g. aqueous ammonia, which acts as the source of the developing gas used by the copying machine and which is readily connectible to the developer input of the machine.

Inasmuch as the life of the fume control material in the treatment chamber has an effect which tapers very gradually, it is often difficult for the operator to judge the point at which the treatment cartridge should be replaced. By physically connecting the cartridge with the developer supply to form a unitary package, and gauging the life of the treatment cartridge to approximately equal or slightly exceed the life of the developer supply, it is possible for the operator to determine visually when the copy development is approaching an inacceptable level, and thereupon discard and replace the entire package without the necessity for carefully monitoring the condition of the materials in the treatment cartridge

DESCRIPTIONS OF THE DRAWINGS

DETAILED DESCRIPTION OF THE PREFERRED EMBODIMENT

Figure 1:
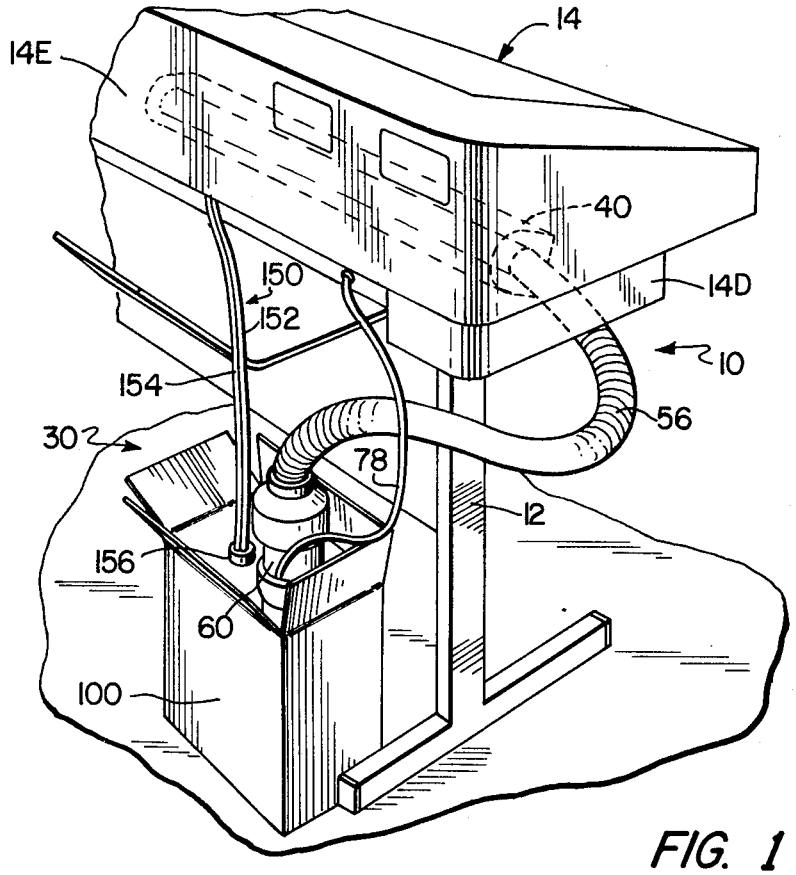
FIG. 1 is a partial perspective of a copier machine of the present invention.

Referring to FIG. 1, a diazotype copier 10 comprises a support frame 12 for supporting the copying machine proper 14, comprising an upper exposure section 14E and a lower development section 14D. This illustrates the general arrangement of one type of copier in wide commercial use at the present time.

To this copier is added the attachment 30 of the present invention, which includes a manifold or wand 40, a hose 56 and a blower 60, and which is used with and readily connectible to and disconnectible from a developer supply and gas treatment package 100 which is floor supported and of disposable construction.

Figure 2:
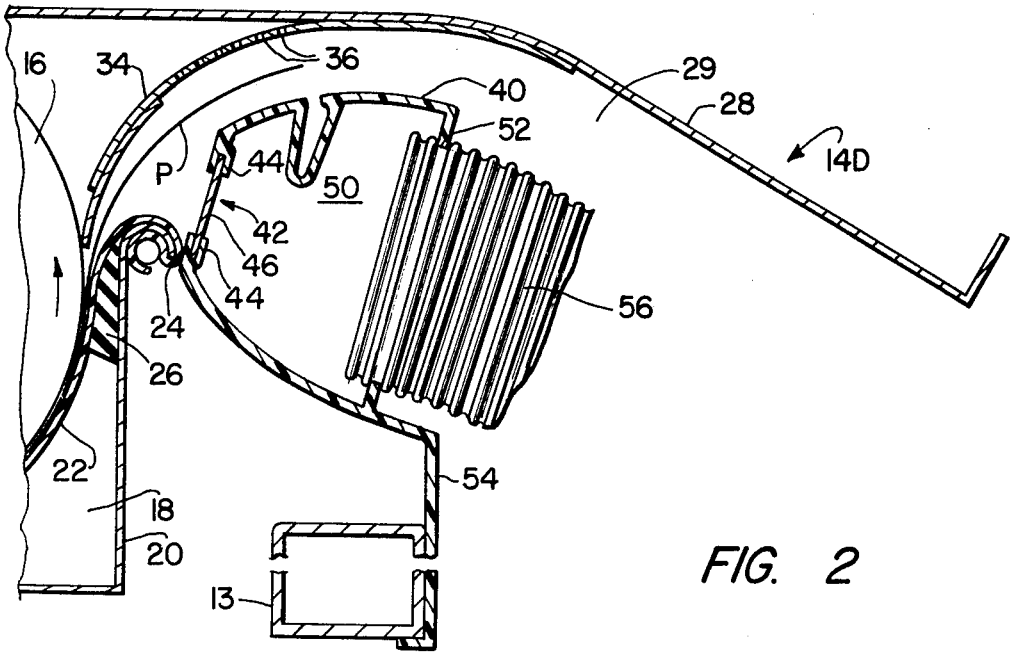
FIG. 2 is a partial transverse section through the developer portion of the copier of FIG. 1 showing the mounting of the wand therein.

In FIG. 2 portions of the development section of the machine are shown including the transport cylinder 16 for moving the copy paper P through the development chamber 18 in the direction of the arrow . This chamber substantially contains the devlopment gas (e.g. an air-ammonia-water vapor mixture) and is defined in part by fixed walls in the machine of which the wall 20 is a representative portion. The chamber 18 is closed off by the presence of the cylinder 16 around which is tautly wrapped a sheet of flexible wear resistant plastic 22 whose ends are appropriately anchored upon the wall portions of the chamber 18, as at 24. Sealing of the chamber 18 is provided for at the margins of the sheet 22 by elongate resilient pads, such as pad 26. The sheet 22 is provided with numerous openings which allow the gas in the chamber 18 to come into contact with the sensitive surface of the copy sheet P as it is advanced through the development chamber by the rotation of the cylinder 16.

At the outlet side of the machine where the developed photocopy issues from between the cylinder 16 and the sheet 22, there is a hood 28 which defines an exit chamber 29. The exit chamber 29 is not closed off but is open to the ambient atmosphere and overlies a member 13 of the frame 12 which is adjacent and parallels the longitudinal dimension of the development chamber 18.

As thus far described the machine is one which has been in commercial use and which is shown in greater detail in U.S. patent application Ser. No. 3,202, filed Jan. 15, 1979, now U.S. Pat. No. 4,241,989, and assigned to the assignee of this application.

In connection with the use of the machine as heretofore described there is a small amount of transfer of development gas from the development chamber 18 to the ambient atmosphere via the chamber 29, especially when the machine is running. This occurs largely due to being carried out on the surface of the moving copy paper. While this amount of transfer is normally insufficient to make use of the machine dangerous or unpleasant, it is sometimes desirable to remove even this possibility for discomfort, to provide insurance against the possible development of leakage past the seals, or both.

Figure 3:
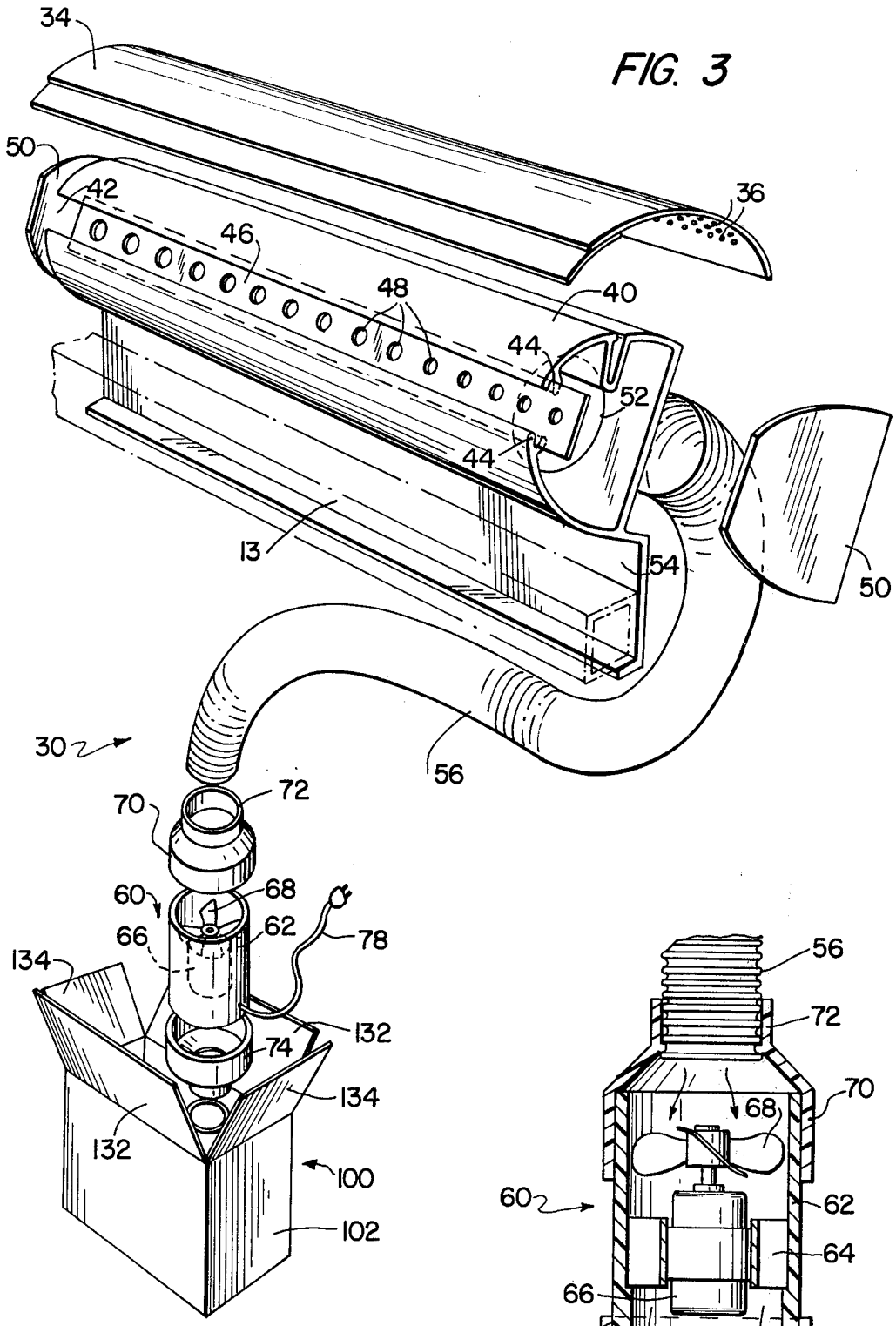
FIG. 3 is an exploded perspective of the attachment of the present invention including the replaceable package.

In order to deal with such traces of fugitive gas the present invention provides an attachment 30, shown in detail in FIG. 3, which captures the air containing this gas and treats it in such manner as to render the contained gas innocuous before returning the air stream to the ambient atmosphere.

The first element of the attachment is the wand 40 which is essentially an extruded tube long enough to extend the length of the development chamber 18. While the wand 40 is shown as located near the place at which the copy sheet P exits from the development chamber, it will be understood that it can also be used to induce air flow from other parts of the machine housing as well. For example there is shown in the drawing a plate designated 34 whose primary function is to strip the emerging copy sheet P from the surface of the transport cylinder 16 and guide it to a location of accessibility. While it might appear that the plate 34 would form a wall of the exit chamber 29, it is provided with plural openings giving free access for air flow from other parts of the machine housing to permit scavanging of any traces of gas which might otherwise unexplainably collect there.

At one side the tube 40 has a lengthwise extending aperture 42 which is defined by grooved marginal beads 44, 44 shaped to receive between them a metering insert 46. The insert 46 is a relatively stiff tape provided with air admission openings 48, and can be installed by sliding its edges into the grooves in the beads 44. At either end of the tube are closures 50, 50 which may either be plates sealed to the tube ends or tightly fitting friction caps, and which are mounted upon the tube ends after the metering insert 46 is in place.

Near one end of the wand 40 is an opening 52 which is sized to receive with a tight snap fit one end of the hose 56 which is of flexible resilient plastic material and connects the wand 40 with the input end of a blower 60. The extrusion of which the wand 40 consists also includes an integral downwardly extending flange 54 which may be attached to the frame member 13 of the machine frame 12 to support the wand in exit chamber 29 with the intake openings 48 located near the position at which the sheet of copy paper P issues from the development chamber 18. Any conventional fasteners may be used for this purpose.

Figure 4:
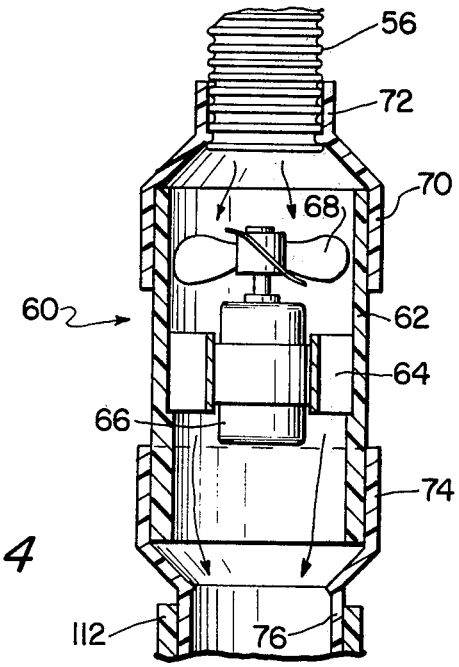
FIG. 4 is an axial section through the blower and its connections.

In FIG. 4, the blower 60 includes a tubular housing 62 with an internal spider 64 supporting an electric motor 66 whose shaft carries an impeller 68. To one end of the housing 62 is affixed an end cap 70 provided with a sleeve extension 72 whose internal configuration provides a snap fit with the exterior of the lower end of the hose 56. At the other end of the housing is affixed another cap 74 with a sleeve extension 76 having an outside diameter which provides a friction fit within a tube found in the treatment cartridge about to be described.

Figure 5:
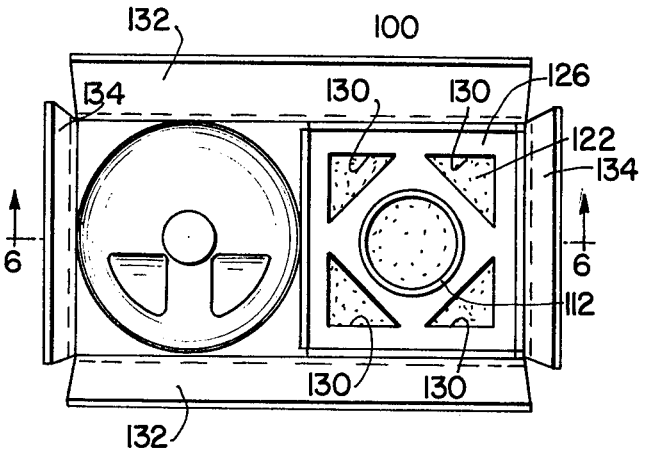
FIG. 5 is top view of the package after being opened for use.
Figure 7:
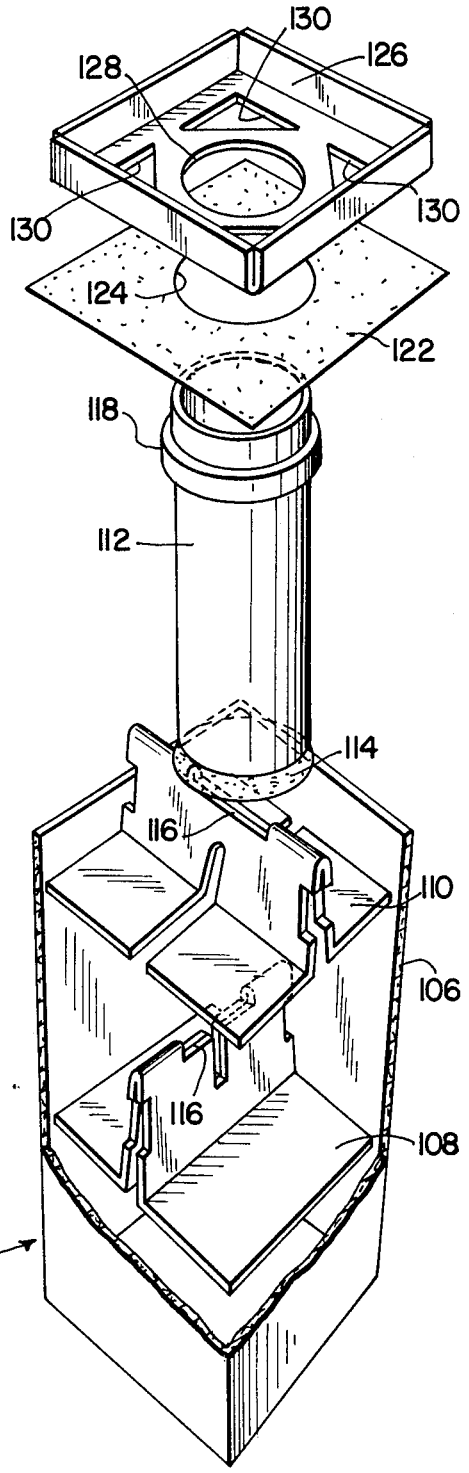
FIG. 7 is an exploded perspective of the gas treatment cartridge portion of the package.
Figure 6:
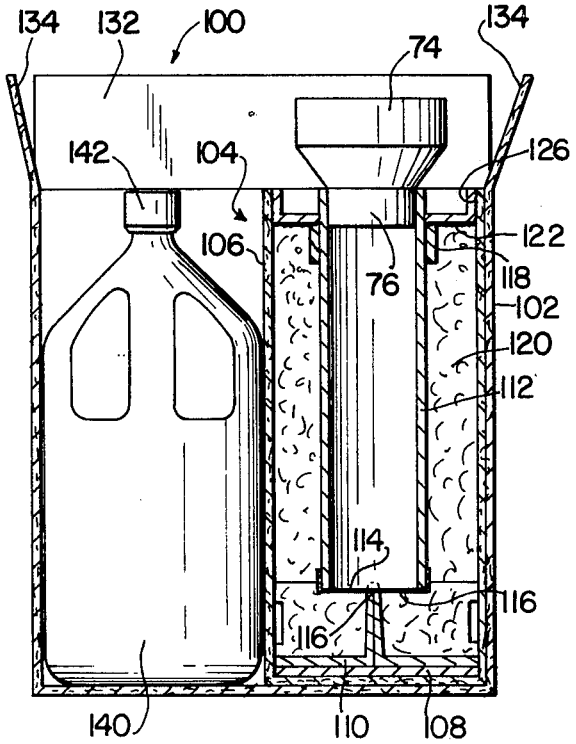
FIG. 6 is a vertical section through the package taken substantially on line 6 of FIG. 5, and also showing the blower connection in place.

The package 100 is shown in detail in FIGS. 5 and 6 and includes a cardboard shipping and unitizing container or box 102. One side of this box (approximately one-half thereof) is occupied by a smaller cardboard container 106 which serves as the shell of a treatment cartridge 104. Two meshing slotted and folded cardboard sheets 108 and 110 are positioned in crossed relationship and inserted in the bottom of the cartridge container 106. This provides a centering device and spacer for the lower end of a cardboard induction tube 112. As seen in FIG. 7, the bottom of the tube is provided with a gas transmitting sheet 114 whose openings are fine enough to allow it to act as a barrier to the treatment material to be presently described, and rests upon the spacer spacers 108 and 110 within the centering notches 116 thereof, respectively. The tube length is such as to place the upper end substantially flush with the upper surface of the cartridge container 106. Near the upper end of the tube 112 is a positioning collar 118 adhered to the outer surface of the tube. When the tube is in place the interior of the container surrounding and beneath the tube 112 is filled with gas treatment material, e.g. fibers of activated charcoal 120 as seen in FIG. 6. A sheet 122 of material which is gas transmitting and acts as a treatment material barrier, which has the outline of the container 106 in plan view, and which is punched with an opening 124 fitting the exterior of the tube 112, is placed on top of the treatment material against the collar 118 where it is held in position by a cardboard centering spider 126. The spider has a central opening for receiving the exterior of the upper end of the tube 112 and has a snug friction fit in the upper end of the container 106, where, if desired, it may be adhesively secured to retain the parts of the cartridge 104 in assembled condition.

The inner diameter of the tube 112 is so selected as to have a snug friction fit with the exterior of the sleeve 76 on the bottom end cap 74 of the blower 60 for assembly as shown in FIGS. 4 and 6.

When the parts are assembled as shown in FIG. 1, and the motor 66 is energized, the impeller 68 causes air to be drawn from the exit chamber 29. The air flows through the openings 48, via the interior of the wand 40, through the hose 56, through the blower housing 62 and finally down through the tube 112 of the treatment cartridge 104. It is then forced upwardly through the treatment material 120 surrounding the tube 112 and escapes to the atmosphere via the barrier sheet 122 and peripheral openings 130 in the spider 126. As the air passes through the treatment material 120, any trace of fugitive development gas which it contains is largely absorbed or otherwise rendered innocuous so that the safety and comfort of the machine surroundings are insured.

Air flow tests combined with tests for volume of contaminant gas in the environment can be readily employed to determine the correct sizing of the motor 66 and the impeller 68 to suit the requirements of any particular situation. In the arrangement illustrated herein, the motor used is a 12 volt D.C. motor drawing about 2 amperes at a load of 2 ounces-inches, and has a maximum power rating of 55 watts. The impeller is a 3 inch diameter wheel with form blades and a $\frac{3}{4}$ pitch, designed to normally generate an air flow value of 40 to 50 CFM. With the restrictions in the air flow path of the type illustrated, the resulting flow of about 15 CFM. is developed.

In order to energize a motor of this type it is convenient to mount on the frame of the machine a 12 volt power supply of conventional construction, served with standard A.C. line voltage input from the power input conductor of the machine, and preferably so wired that the ON—OFF switch for the machine will also control the power to the motor 66 whereby the latter will be operating whenever the machine is turned on. The motor 66 is provided with a supply conductor 78 which is plugged into such D.C. power supply if used, or into the normal AC supply when a motor of corresponding type and voltage rating is adopted.

Because the width of diazotype copying machines is usually substantial, a long wand 40 is normally required and some variation in air flow will be apt to occur at various points along its length. For this reason it is often found desirable to use openings 48 of non-uniform size in the strip 46, with slightly larger openings at the portions of the wand 40 which are more remote from the air exit opening 52. Adjustment of the amount of air flow in general, and localized adjustment along the length of the wand 40 can be easily effected by punching strips 46 with holes 48 of various sizes, slipping them into and out of the grooves in beads 44, and testing the air flow results for various openings until the most efficacious arrangement for any specific machine geometry is attained.

The package 100 is completed by placing in the side of the box 102 not occupied by the cartridge 104, a disposable plastic jug 140 of material (e.g. aqueous ammonia) capable of supplying the development gas. The jug 140 is provided with a sealing shipping cap 142.

As seen in FIGS. 5 and 6, the upper end of the box 102 is provided with flaps 132 and 134 which, after the cartridge 104 and sealed jug 140 are in place, can be folded over and sealed to form the shipping package 100.

Mounting of the attachment 30 upon any diazo copying machine 10 can be easily effected by mounting the flange 54 of the preassembled wand 40 upon a frame member 13 of the machine, first drilling and/or tapping any fastener openings, if required. One end of the hose 56 is snapped into the opening 52 and the other into the sleeve 72 of the blower end cap 70. Both end caps 70 and 74 are forced onto the blower housing 62, and the motor supply conductor 78 is plugged into a suitable power supply. If a special power supply is used, such as the 12 volt D.C. power supply mentioned above, the power supply is first connected electrically to standard line voltage terminals (e.g. 115 VAC terminals) in the machine circuit and is attached in any conventional manner to the machine frame.

Diazo copiers are customarily equipped with two flexible gas flow conduits, one for developer gas supply and the other for return of the gas to the supply container to complete the circuit and a fitting which associates these conduits and connects them in operating fashion to the mouth of a supply container. In FIG. 1 these elements are generally shown as an assembly at 150, including a supply conduit 152, a return conduit at 154 and a fitting at 156 whose attachment features (e.g. threads) determine the design of the neck of the jug 140.

With the attachment connected to the diazo copying machine as previously described, all that is required to prepare the same for fume control is to unseal the top of a box 102 of the package 100, force the sleeve 76 of the blower housing end cap 74 into the open upper end of the tube 112. When the blower motor 66 is energized (preferably by turning the copier on) the impeller will rotate, thereby inducing a flow of air which will draw the gases from the exit chamber 29 through the openings 48, into the wand 40, down the hose 56, through the blower housing 62 and down the tube 112 to the bottom of the inner container or cartridge shell 106.

At this point the flow is guided outwardly and then passes upwardly through the treatment material 120 within the cartridge 104 and surrounding the tube 112 until it exhausts through the peripheral openings 130 in the spider 126. In transit any traces of waste gas in the air stream have been absorbed or otherwise rendered innocuous.

The connecting together of the cartridge 104 and jug 140 of development material provides a special benefit. Whenever the operator detects that the concentration of the development material has dropped to a point such that print development has dropped below standard, he will perform the customary operation of detaching the spent supply container from the fitting 156, discarding the spent container, removing the cap from a replacement container and attaching it to the fitting 156. According to the present invention, the amount of development agent in the development container (in this case the jug 140) is determined, and a standard term of development effectiveness of this development material determined. The cartridge 104 is then so constructed that the amount of treatment material 120 contained in the same will have a use life approximately equal to or just slightly longer than the development effectiveness period of the material in the jug 140.

With this arrangement an operator can both effectively and economically service his machine with both the development supplies and the fume control supplies by relying merely upon the copy quality results. When they begin to appear substandard he merely disconnects the package 100 at two points, 76 and 156, discards the entire package, and then opens the sealing flaps on a replacement package 100 and connects it at the same two points 76 and 156 without any need to concern himself with the status of the fume control function.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A copying machine employing a gas generating development medium comprising:

a housing; and means for scavenging fugitive gas fumes emitted from said development medium from said housing, said scavenging means comprising:

an elongated intake manifold mounted in said housing, said manifold comprising an extruded tubular element with an elongated opening on one side thereof, said opening being bounded by grooved beads, and a strip of material having edges supported in said grooved beads, said strip having air intake openings spaced therealong, and an output opening in said manifold opposite said elongated opening located at one end of said tubular element;

a blower including a blower housing for evacuating said fugitive gas fumes from said copy machine housing, said blower housing having an intake end and an exhaust end;

a flexible hose connected at one end to said output opening in said manifold and at the other end to said intake end of said blower housing;

said blower housing including a connecting means at the exhaust end thereof connectable with a disposable and replacable gas treatment cartridge, said cartridge providing a support for said blower housing.

2. A copying machine as set forth in claim 1 in which the hose is of resilient material, and in which the manifold structure adjacent said output opening and the said intake end of said blower housing are designed to connect with said resilient hose in a snap fitting relationship.

3. A scavenging attachment for fugitive gas fumes emitted within and from a copying machine of the type having a housing and employing a gas generating development medium which provides the source of said fugitive gas fumes, said attachment comprising:

an elongated intake manifold within said copy machine housing including a mounting flange for connection with a part of said copy machine within said housing, said manifold comprising an extruded tubular element with an elongated opening on one side, said opening being bounded by grooved beads, and a strip of material supported by the edges of said tubular element in said grooved beads, said strip having air intake openings spaced therealong and an output opening in said manifold opposite said elongated opening located at one end of said tubular element;

a blower including a blower housing for evacuating said gas fumes, having an intake end and an exhaust end; and a flexible hose connected at one end to said output opening in said manifold and at the other end to said intake end of said blower housing, said blower housing including a connecting means at the exhaust end thereof connectable with a disposable and replacable gas treatment cartridge which provides support for said blower housing.

4. An attachment as set forth in claim 3 in which the hose is of resilient material, and in which the manifold structure adjacent said output opening and the said intake end of said blower housing are designed to connect with said resilient hose in a snap fitting relationship.

5. An attachment as set forth in claims 1 or 3 in which the air intake openings in said strip are of more than one size, and in which the opening sizes are so designed as to make air flow through the various openings closer to parity than uniform openings would provide.

6. At attachment as set forth in claim 3 which also includes a disposable and readily replaceable gas treatment cartridge having a top and a base, arranged to the floor supported on its base and to have at its top a connection opening for receiving the connection means at said exhaust end of said blower housing to support the blower on said cartridge, said cartridge also having at its top, peripheral openings for the exhaust of air being moved through the cartridge by said blower.

7. A copying machine as set forth in claim 1 which also includes a disposable and readily replaceable gas treatment cartridge having a top and a base, arranged to be floor supported on its base and to have at its top a connection opening for receiving the connection means at said exhaust end of said blower housing to support the blower on said cartridge, said cartridge also having at its top, peripheral openings for the exhaust of air being moved through the cartridge by said blower.

* * * * *